US009285820B2

(12) United States Patent
Kalb et al.

(10) Patent No.: US 9,285,820 B2
(45) Date of Patent: Mar. 15, 2016

(54) ULTRA-LOW NOISE VOLTAGE REFERENCE CIRCUIT

(71) Applicant: ANALOG DEVICES, INC., Norwood, MA (US)

(72) Inventors: Arthur J. Kalb, Santa Clara, CA (US); John Sawa Shafran, San Jose, CA (US)

(73) Assignee: Analog Devices, Inc., Norwood, MA (US)

( * ) Notice: Subject to any disclaimer, the term of this patent is extended or adjusted under 35 U.S.C. 154(b) by 283 days.

(21) Appl. No.: 13/757,241

(22) Filed: Feb. 1, 2013

(65) Prior Publication Data

US 2013/0200878 A1 Aug. 8, 2013

Related U.S. Application Data

(60) Provisional application No. 61/594,851, filed on Feb. 3, 2012.

(51) Int. Cl.

| | |
|---|---|
| ***G05F 3/16*** | (2006.01) |
| ***G05F 3/20*** | (2006.01) |
| ***G05F 3/30*** | (2006.01) |

(52) U.S. Cl.

CPC .. *G05F 3/16* (2013.01); *G05F 3/20* (2013.01); *G05F 3/30* (2013.01)

(58) Field of Classification Search

CPC ..... G05F 3/16

See application file for complete search history.

(56) References Cited

U.S. PATENT DOCUMENTS 4,435,655 A * 3/1984 Hauser ..... 327/350
4,460,865 A 7/1984 Bynum et al.

(Continued)

FOREIGN PATENT DOCUMENTS

CN 101241378 A 8/2008
CN 102073334 5/2011
CN 102207741 A 10/2011

OTHER PUBLICATIONS

PCT Search Report of Mar. 21, 2014 for International Patent Application No. PCT/US2013/024472, filed Feb. 1, 2013, in 7 pages.

(Continued)

*Primary Examiner* — Emily P Pham

(74) *Attorney, Agent, or Firm* — Knobbe Martens Olson & Bear LLP

(57) ABSTRACT

A voltage reference circuit comprises a plurality of $\Delta V_{BE}$ cells, each comprising four bipolar junction transistors (BJTs) connected in a cross-quad configuration and arranged to generate a $\Delta V_{BE}$ voltage. The plurality of $\Delta V_{BE}$ cells are stacked such that their $\Delta V_{BE}$ voltages are summed. A last stage is coupled to the summed $\Delta V_{BE}$ voltages and arranged to generate one or more $V_{BE}$ voltages which are summed with the $\Delta V_{BE}$ voltages to provide a reference voltage. This arrangement serves to cancel out first-order noise and mismatch associated with the two current sources present in each $\Delta V_{BE}$ cell, such that the voltage reference circuit provides ultra-low 1/f noise in the bandgap voltage output.

29 Claims, 5 Drawing Sheets

(56) References Cited

U.S. PATENT DOCUMENTS

| | | | | |
|---|---|---|---|---|
| 4,618,816 | A | 10/1986 | Monticelli | |
| 4,748,420 | A * | 5/1988 | Metz | 330/149 |
| 5,180,967 | A * | 1/1993 | Yamazaki | 323/315 |
| 5,349,286 | A * | 9/1994 | Marshall et al. | 323/315 |
| 5,448,158 | A * | 9/1995 | Ryat | 323/315 |
| 5,614,850 | A * | 3/1997 | Corsi et al. | 327/55 |
| 6,002,293 | A * | 12/1999 | Brokaw | 327/540 |
| 6,232,829 | B1 * | 5/2001 | Dow | 327/539 |
| 7,088,085 | B2 | 8/2006 | Marinca | |
| 8,228,052 | B2 | 7/2012 | Marinca | |
| 8,421,433 | B2 | 4/2013 | Vyne | |
| 8,508,211 | B1 * | 8/2013 | Anderson | 323/313 |
| 2001/0033192 | A1 * | 10/2001 | Knierim et al. | 327/355 |
| 2004/0095186 | A1 * | 5/2004 | Bernard | 327/539 |
| 2005/0001605 | A1 | 1/2005 | Marinca | |
| 2005/0088163 | A1 * | 4/2005 | Tachibana et al. | 323/313 |
| 2008/0007243 | A1 * | 1/2008 | Matsumoto et al. | 323/313 |
| 2009/0039861 | A1 * | 2/2009 | Wang | 323/313 |
| 2009/0121698 | A1 | 5/2009 | Harvey | |
| 2009/0302823 | A1 * | 12/2009 | Chao et al. | 323/313 |
| 2011/0241646 | A1 | 10/2011 | Vyne | |
| 2013/0033245 | A1 * | 2/2013 | Wong | 323/281 |

OTHER PUBLICATIONS

Office Action dated Feb. 27, 2015 in Chinese Patent Application No. 201380007710.0, filed Aug. 1, 2014, in 8 pages.

* cited by examiner

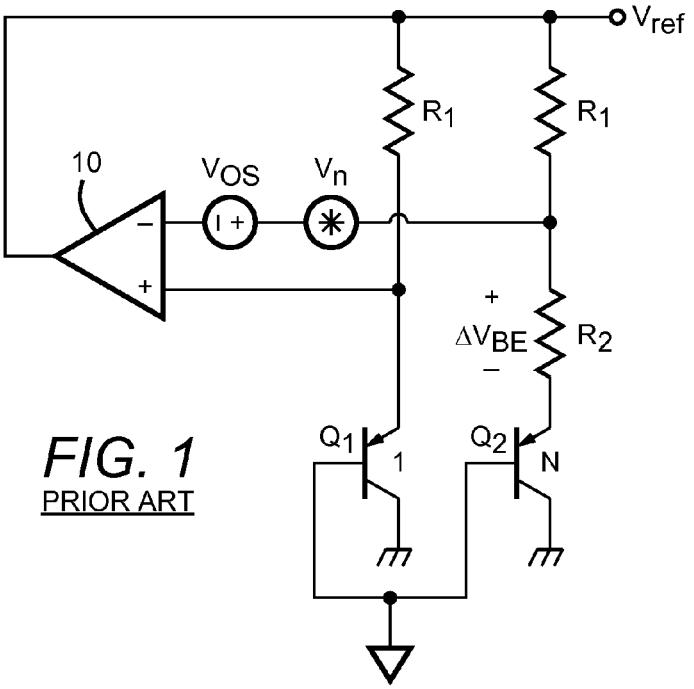
FIG. 1
PRIOR ART
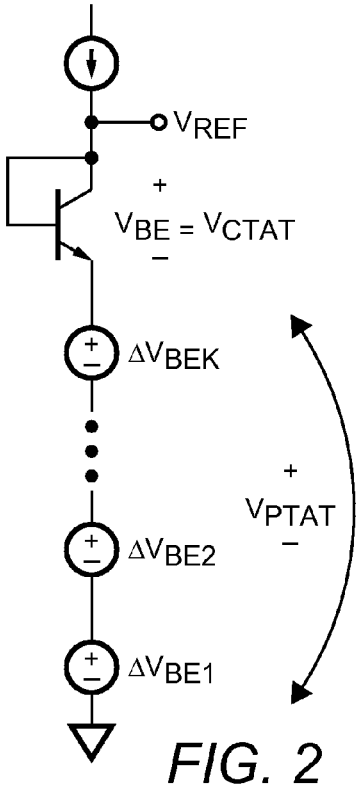
FIG. 2
PRIOR ART
FIG. 3
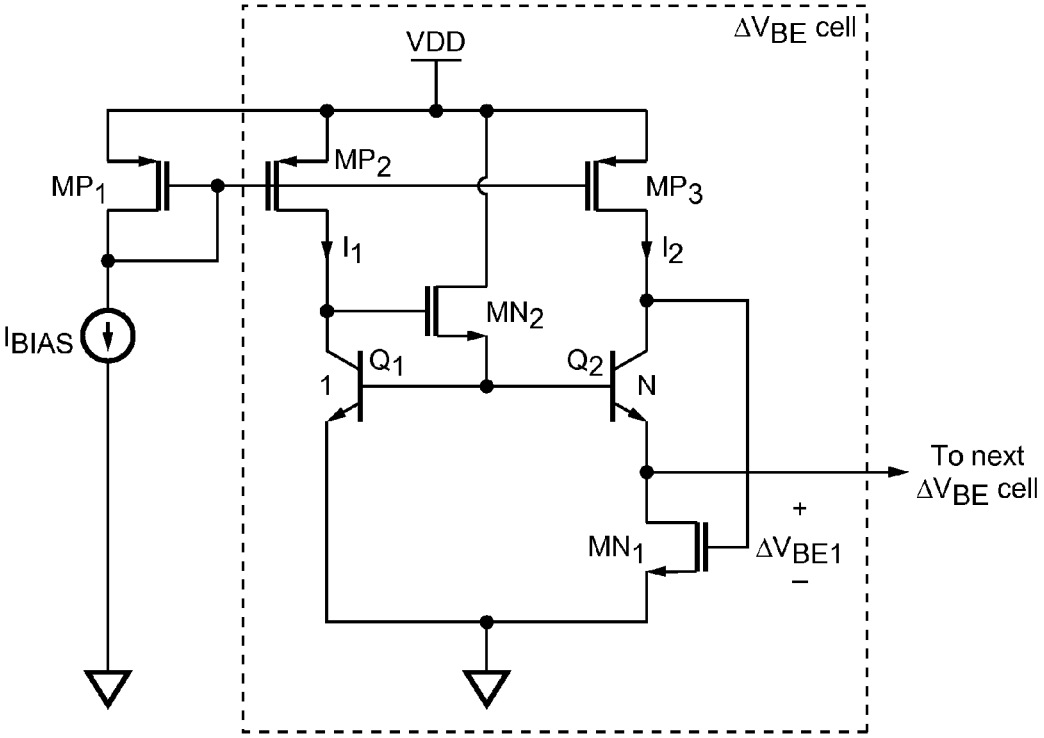

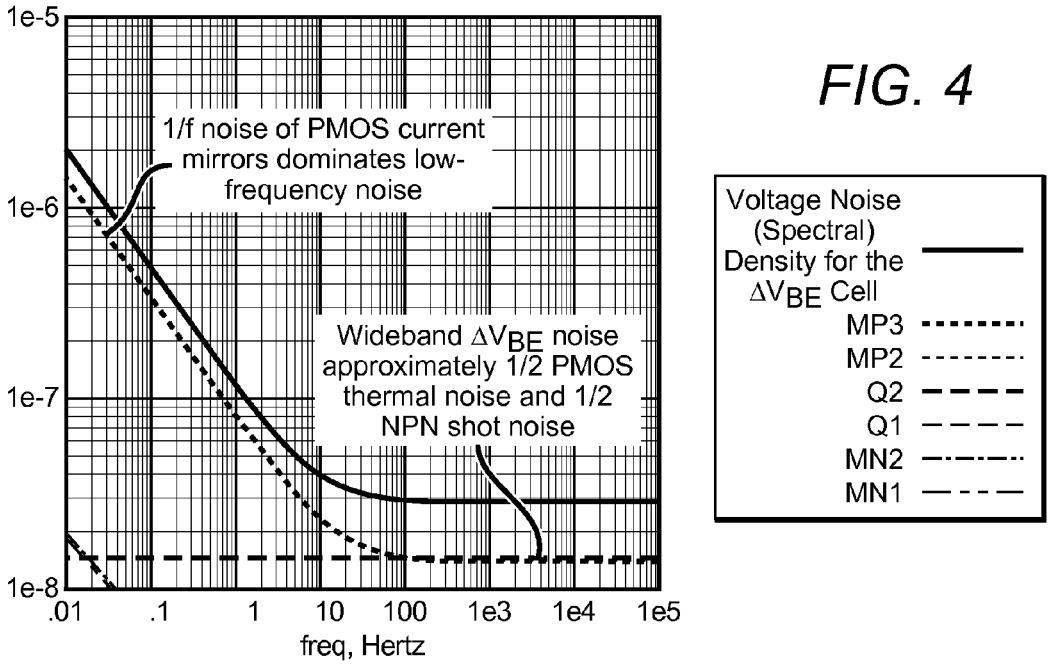
FIG. 4
FIG. 5
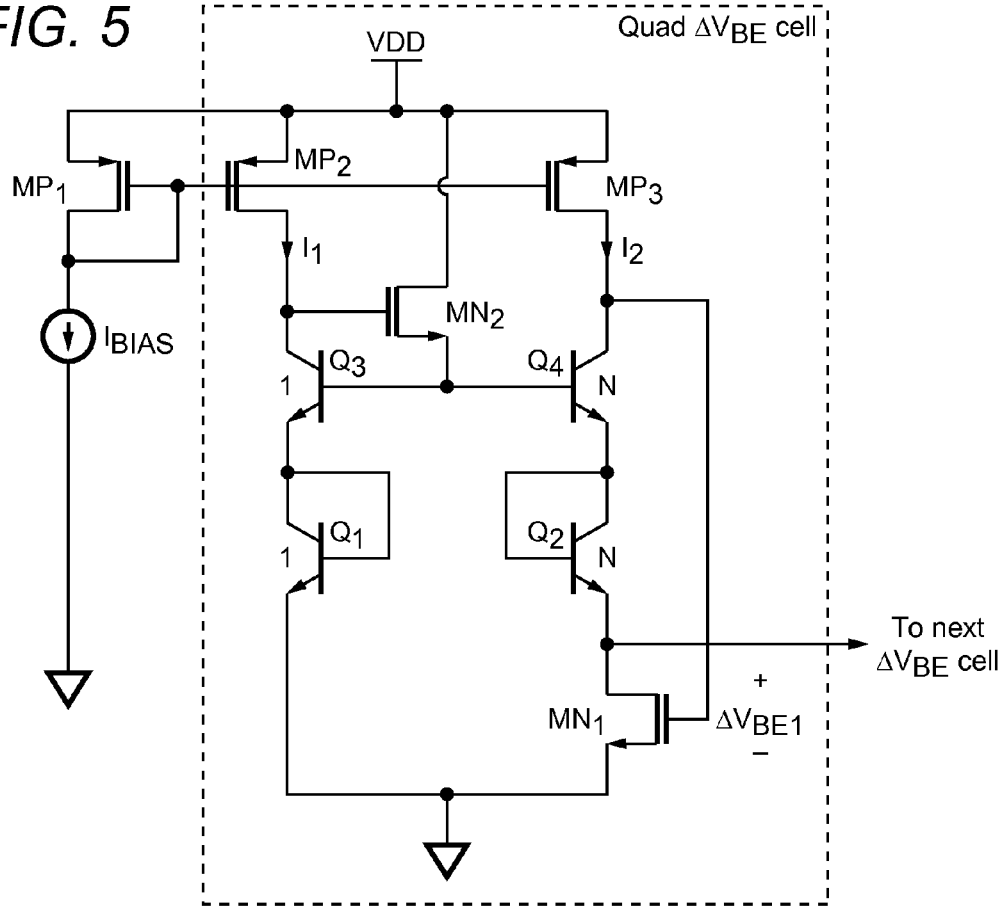

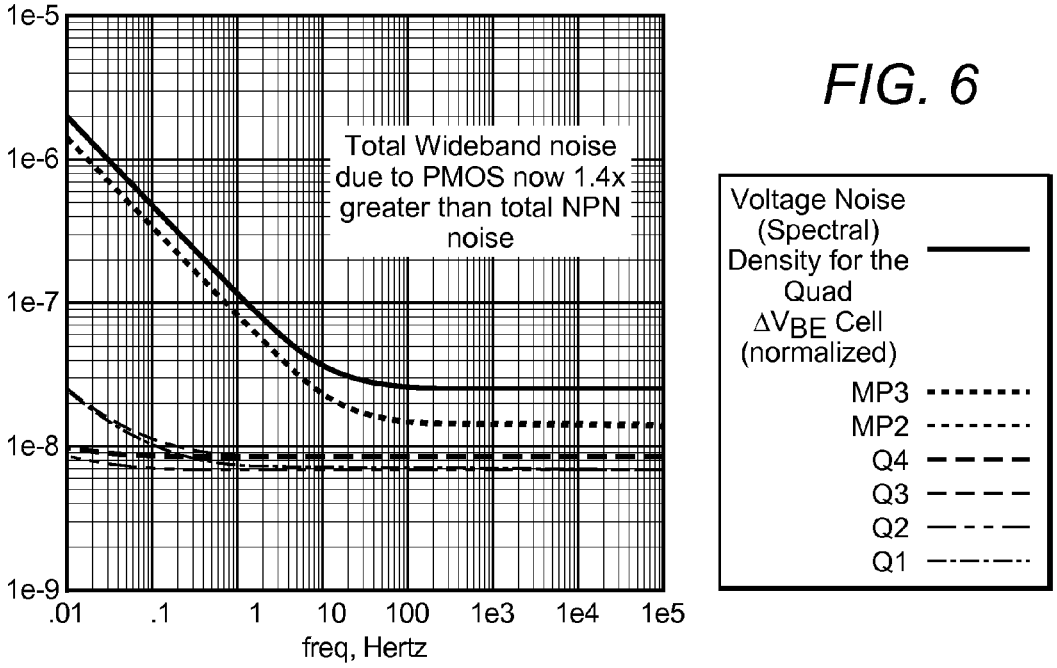
FIG. 6
FIG. 7
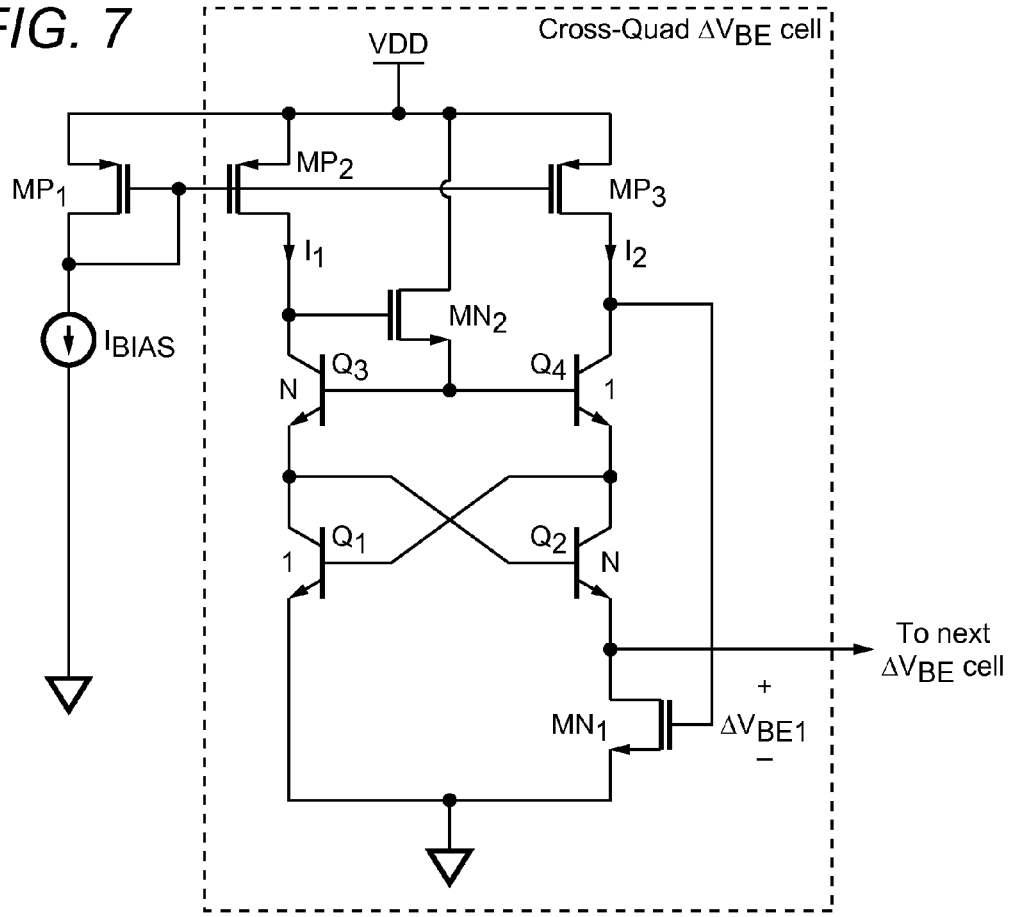

ULTRA-LOW NOISE VOLTAGE REFERENCE CIRCUIT

RELATED APPLICATIONS

This application claims the benefit of provisional patent application No. 61/594,851 to Kalb et al., filed Feb. 3, 2012.

BACKGROUND OF THE INVENTION

1. Field of the Invention

This invention relates generally to voltage reference circuits, and more particularly to voltage reference circuits having very low noise specifications.

2. Description of the Related Art

One type of voltage reference circuit having a low or zero temperature coefficient (TC) is the bandgap voltage reference. The low TC is achieved by generating a voltage having a positive TC (PTAT) and summing it with a voltage having a negative TC (CTAT) to create a reference voltage with a first-order zero TC. One conventional method of generating a bandgap reference voltage is shown in FIG. 1. An amplifier 10 provides equal currents to bipolar junction transistors (BJTs) Q1 and Q2; however, the emitter areas of Q1 and Q2 are intentionally made different, such that the base-emitter voltages for the two transistors are different. This difference, $\Delta V_{BE}$, is a PTAT voltage which appears across resistor R2. It is summed with the base-emitter voltage ($V_{BE}$) of Q1, which is a CTAT voltage, to generate reference voltage $V_{REF}$, which is given by:

$$V_{REF}=V_{BE,Q1}+V_{PTAT}=T_{BE,Q1}+K(V_T\ln(+V_{OS}),$$

where $K=R_1/R_2$, $V_T$ is the thermal voltage, N is the ratio of the emitter areas and $V_{OS}$ is the offset voltage of amplifier 10.

When so arranged, the noise $v_{n,PTAT}$ generated in the creation of the PTAT voltage is given by:

$$v_{n,PTAT}=\sqrt{(v_{n,amp}^2+v_{n,Q1}^2+v_{n,Q2}^2+v_{n,R2}^2)K^2+v_{n,R1}^2}$$

Another bandgap voltage reference approach, described in U.S. Pat. No. 8,228,052 to Marinca, is illustrated in FIG. 2. Explicit amplifiers are not used with this $\Delta V_{BE}$ voltage generation method in favor of stacked, independent $\Delta V_{BE}$ cells. Here, the output of the voltage reference is given by:

$$V_{REF}=\Delta V_{BE1}+\Delta V_{BE2}+\ldots+\Delta V_{BEK}+V_{BE}$$

The noise of each $\Delta V_{BE}$ cell is uncorrelated with the others; thus, the noise contributions to the PTAT voltage, $v_{n,PTAT}$, sum in an RMS fashion as given by:

$$v_{n,PTAT}=\sqrt{v_{n,\Delta VBE1}^2+v_{n,\Delta VBE2}+\ldots+v_{n,\Delta VBEK}^2}$$

Though this approach generates less noise that the conventional approach shown in FIG. 1, the noise level may still be unacceptably high for certain implementations.

SUMMARY OF THE INVENTION

A voltage reference circuit is presented which is capable of providing a noise figure lower than those associated with the prior art methods described above.

The present voltage reference circuit comprises a plurality of $\Delta V_{BE}$ cells, each comprising four bipolar junction transistors (BJTs) connected in a cross-quad configuration and arranged to generate a $\Delta V_{BE}$ voltage. The plurality of $\Delta V_{BE}$ cells are stacked such that their $\Delta V_{BE}$ voltages are summed. A last stage is coupled to the summed $\Delta V_{BE}$ voltages; the last stage is arranged to generate a $V_{BE}$ voltage which is summed with the $\Delta V_{BE}$ voltages to provide a reference voltage. This arrangement serves to cancel out the first-order noise and mismatch associated with the two current sources present in each $\Delta V_{BE}$ cell, such that the present voltage reference circuit provides ultra-low 1/f noise in the bandgap voltage output.

These and other features, aspects, and advantages of the present invention will become better understood with reference to the following description and claims.

BRIEF DESCRIPTION OF THE DRAWINGS

FIG. 1 is a schematic diagram of a known bandgap voltage reference.

FIG. 2 is a block diagram of another known bandgap voltage reference.

FIG. 3 is a schematic diagram of a $\Delta V_{BE}$ cell.

FIG. 4 is a plot of the constituent noise components of a $\Delta V_{BE}$ cell such as that shown in FIG. 3.

FIG. 5 is a schematic diagram of a quad $\Delta V_{BE}$ cell.

FIG. 6 is a plot of the constituent noise components of a quad $\Delta V_{BE}$ cell such as that shown in FIG. 5.

FIG. 7 is a schematic diagram of a cross-quad $\Delta V_{BE}$ cell.

DETAILED DESCRIPTION OF THE INVENTION

Figure 8:
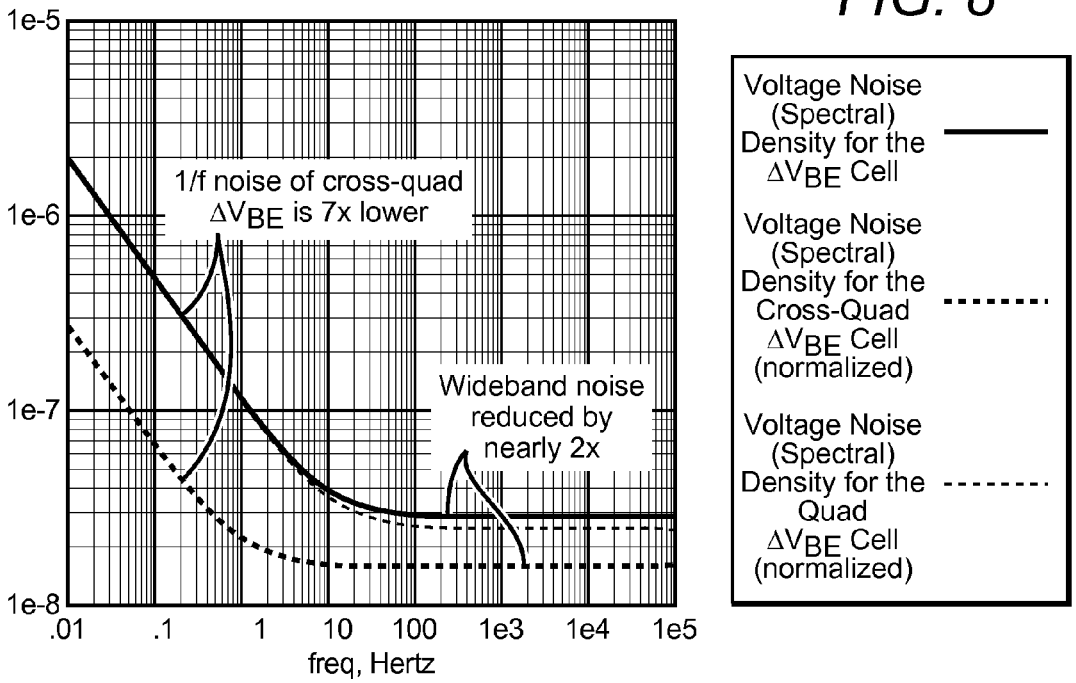
FIG. 8 is a plot comparing the noise of a cross-quad $\Delta V_{BE}$ with that of quad $\Delta V_{BE}$ cell and a basic $\Delta V_{BE}$ cell.

One possible implementation of a cell capable of generating a $\Delta V_{BE}$ voltage is shown in FIG. 3 (Marinca, ibid.). BJTs $Q_1$ and $Q_2$ are arranged such that the emitter area of $Q_2$ is N times that of $Q_1$, and FETs $MP_1$ and $MP_2$ are arranged to provide equal currents $I_1$ and $I_2$ to $Q_1$ and $Q_2$, respectively. An NMOS FET $MN_1$ functions as a resistance across which the cell's output voltage (ΔVBE) appears, given by:

$$\Delta V_{BE}=V_{BE,Q1}-V_{BE,Q2}=V_T\ln\left(\frac{I_{C1}}{I_{S1}}\right)-V_T\ln\left(\frac{I_{C2}}{I_{S2}}\right)=V_T\ln\left(\frac{I_{C1}}{I_{S1}}\cdot\frac{I_{S2}}{I_{C2}}\right)\equiv V_T\ln(N)$$

wherein $V_T$ is the thermal voltage, $I_{C1}$ and $I_{C2}$ are the collector currents of Q1 and Q2, respectively, and $I_{S1}$ and $I_{S2}$ are the saturation currents of Q1 and Q2, respectively. Thus, the $\Delta V_{BE}$ voltage is purely dependent on the emitter area ratio, nominally N, of NPNs $Q_1$ and $Q_2$, the matching of currents $I_1$ and $I_2$ (generated by the PMOS current mirror transistors $MP_2$ and $MP_3$), and the matching of $Q_1$ and $Q_2$. NMOS FET $MN_1$ acts as a variable resistor, which is tuned by the circuit to sink the current necessary to keep the cell in an equilibrium state. Multiple $\Delta V_{BE}$ cells of this sort could be "stacked"—i.e., connected such that their individual $\Delta V_{BE}$ voltages are summed—and then coupled to a stage which adds a $V_{BE}$ voltage to the summed $\Delta V_{BE}$ voltages to provide a voltage reference circuit. An NMOS FET $MN_2$ is preferably connected as shown and used to drive the bases of Q1 and Q2, though other means might also be used; a BJT might also be used for this purpose.

The constituent noise components of a $\Delta V_{BE}$ cell such as that shown in FIG. 3, designed on a standard CMOS process, are shown in FIG. 4. At frequencies below 10 Hz, the 1/f noise of the PMOS FETs $MP_2$ and $MP_3$ dominates. Above 10 Hz, the overall $\Delta V_{BE}$ noise is split approximately equally between the PMOS current mirror thermal noise and the shot noise of NPNs $Q_1$ and $Q_2$. Note that even if $MP_2$ and $MP_3$ match perfectly, the small-signal collector currents of $Q_1$ and $Q_2$ are not equal because $MP_2$ and $MP_3$ each has its own uncorrelated noise; this differential noise results in noise in the $\Delta V_{BE}$ output. The 1/f noise is more pronounced in MOS devices than bipolar devices; thus, the contribution of the PMOS noise to the total noise is dominant at frequencies below 10 Hz in FIG. 4.

One could theoretically improve the noise performance of the $\Delta V_{BE}$ cell discussed above by using two sets of two NPNs to create the $\Delta V_{BE}$ voltage. This approach, referred to herein as a "quad $\Delta V_{BE}$ cell" for its four NPNs, is shown in FIG. 5. Note that, as above, multiple quad $\Delta V_{BE}$ cells could be stacked and coupled to a stage which adds a $V_{BE}$ voltage to the summed $\Delta V_{BE}$ voltages to provide a voltage reference circuit.

The output voltage $\Delta V_{BE}$ of this configuration is given by:

$$\begin{aligned}\Delta V_{BE} &= V_{BE,Q1} + V_{BE,Q3} - V_{BE,Q2} - V_{BE,Q4}\\ &= V_T \ln\left(\frac{I_{C1}}{I_{S1}} \cdot \frac{I_{C3}}{I_{S3}} \cdot \frac{I_{S2}}{I_{C2}} \cdot \frac{I_{S4}}{I_{C4}}\right) \equiv V_T \ln(N^2)\\ &= 2V_T \ln(N), \text{ assuming equal } \beta\text{'s}\end{aligned}$$

In the quad $\Delta V_{BE}$ cell, the $\Delta V_{BE}$ voltage increases by a factor of 2, while the NPN shot noise contribution to the $\Delta V_{BE}$ voltage increases by a factor of $\sqrt{2}$ since the NPN shot noise generators are uncorrelated. As a result, the quad $\Delta V_{BE}$ cell provides a signal-to-noise ratio (SNR) improvement of:

$$\sqrt{((4/6)/(1/2))} = \sqrt{(4/3)} = \sim 1.15,$$

if the overall wideband $\Delta V_{BE}$ noise is split evenly between PMOS thermal noise and NPN shot noise.

As noted above, the quad cell increases $\Delta V_{BE}$ magnitude by a factor of 2, which corresponds with an increase in signal power by 4. However, the PMOS noise magnitude also doubles (it sees twice the gain in converting from current to voltage), so it increases in power by 4. The shot noise increases because of a doubling in the number of noise generators. There are twice as many noise generators, so the shot noise power goes up by 2. FIG. 6 depicts the constituent noise components of the quad $\Delta V_{BE}$ cell.

A closer look at the quad $\Delta V_{BE}$ cell reveals that $I_1 \neq I_2$ in a small-signal sense due to the uncorrelated noise of the PMOS current mirrors $MP_2$ and $MP_3$. The high-current-density pair $Q_1$ and $Q_3$ sees $I_1$ with its independent noise, while the low-current-density pair $Q_2$ and $Q_4$ sees $I_2$ with its own independent noise. The uncorrelated nature of the PMOS noise sources leads to noise in the generation of the $\Delta V_{BE}$ voltage with the quad $\Delta V_{BE}$ cell. Thus, while the SNR of the quad $\Delta V_{BE}$ cell is improved over the standard ΔVBE cell, the performance may still be unacceptable for some applications.

A voltage reference circuit capable of providing ultra-low noise performance is now described. The present voltage reference circuit employs a "cross-quad $\Delta V_{BE}$ cell" that to first-order cancels out the noise and mismatch of the two current sources which provide currents $I_1$ and $I_2$. Without the cross-quad connection, the current sources can be the dominant sources of noise and mismatch in the overall $\Delta V_{BE}$ output voltage. Here, however, the voltage reference provides ultra-low 1/f noise in the bandgap voltage output, making it suitable for demanding applications such as medical instrumentation. For example, one possible application is as an ultra-low-noise voltage reference for an electrocardiograph (ECG) medical application-specific standard product (ASSP).

A schematic of a preferred embodiment of the cross-quad $\Delta V_{BE}$ cell is shown in FIG. 7. The output of this arrangement is given by:

$$\Delta V_{BE} = V_{BE,Q1} + V_{BE,Q4} - V_{BE,Q3} - V_{BE,Q2} = V_T \ln\left(\frac{I_{C1} \cdot I_{C4}}{I_{C2} \cdot I_{C3}} \frac{I_{S2} \cdot I_{S3}}{I_{S1} \cdot I_{S4}}\right)$$

where $I_{S1}$, $I_{C1}$, $I_{S2}$, $I_{C2}$, $I_{S3}$, $I_{C3}$, $I_{S4}$, and $I_{C4}$ are the saturation and collector currents of transistors Q1, Q2, Q3, and Q4, respectively.

Since $I_{C3}=I_1$ and $I_{C4}=I_2$, it can be shown that:

$$I_{C1} = +\frac{\beta_1\beta_2\beta_3}{(\beta_3+1)(\beta_1\beta_2-1)} I_1 - \frac{\beta_1\beta_4}{(\beta_4+1)(\beta_1\beta_2-1)} I_2$$

and $$I_{C2} = -\frac{\beta_2\beta_3}{(\beta_3+1)(\beta_1\beta_2-1)} I_1 + \frac{\beta_1\beta_2\beta_4}{(\beta_4+1)(\beta_1\beta_2-1)} I_2$$

where, $\beta_1$, $\beta_2$, $\beta_3$ and $\beta_4$ are the current gains of transistors Q1, Q2, Q3, and Q4, respectively. Typically, transistors Q1 and Q4 will have an emitter area, A, and transistors Q2 and Q4 will have an emitter area N*A. Then, the output is given by:

$$\Delta V_{BE} = V_{BE,Q1} + V_{BE,Q4} - V_{BE,Q3} - V_{BE,Q2} = V_T \ln\left(N^2 \cdot \frac{I_{C1} \cdot I_{C4}}{I_{C2} \cdot I_{C3}}\right)$$

It should be noted that other scalings of the emitter areas are possible. As above, NMOS FET $MN_1$ is preferably employed as a resistance across which the cell's output voltage ($\Delta V_{BE}$) appears, and NMOS FET $MN_2$ is preferably connected as shown to drive the bases of Q1 and Q2; note, however, that $MN_2$ might alternatively be implemented with an NPN transistor, and that the functions provided by $MN_1$ and $MN_2$ might alternatively be provided by other means.

In this configuration, the high-current-density pair $Q_1$ and $Q_3$ and the low-current-density pair $Q_2$ and $Q_4$ each have one NPN with a collector current originating from $I_1$ and one NPN with a collector current originating from $I_2$. The noise components introduced by $MP_2$ and $MP_3$ are forced to be correlated via the cross-quad configuration. Thus, the 1/f and wideband noise, and the mismatch of the PMOS current mirror transistors, are rejected to an amount limited only by the β of the NPNs used in the cross-quad configuration.

The last statement can be better appreciated by revisiting the $I_{C1}$ and $I_{C3}$ equations shown above, which indicate that currents $I_{C1}$ and $I_{C3}$ are not perfectly correlated due to finite β. Current $I_{C3}$ is purely a function of $I_1$, while $I_{C1}$ is a function of $I_1$ and $I_2$; the relative contribution of $I_2$ to $I_{C1}$ depends on β. The same condition applies to $I_{C2}$ and $I_{C4}$. The sensitivity of the $\Delta V_{BE}$ voltage to noise in the current sources can be calculated as the partial derivative of the $\Delta V_{BE}$ voltage with respect to each current. For simplicity of calculation, the transistor current gains will be assumed to be equal to β and the calculation will be carried out at the nominal operating point I1=I2=I. The sensitivities are then given by:

$$\frac{\partial}{\partial I_1}\Delta V_{BE} = \frac{\partial}{\partial I_1} V_T \ln\left(N^2 \cdot \frac{I_{C1} \cdot I_{C4}}{I_{C2} \cdot I_{C3}}\right) = \frac{2}{\beta - 1} \cdot \frac{V_T}{I}$$

$$\frac{\partial}{\partial I_2}\Delta V_{BE} = \frac{\partial}{\partial I_2} V_T \ln\left(N^2 \cdot \frac{I_{C1} \cdot I_{C4}}{I_{C2} \cdot I_{C3}}\right) = -\frac{2}{\beta - 1} \cdot \frac{V_T}{I}$$

It is clear that the sensitivities are inversely proportional to the current gain, β. The conclusion is that the PMOS current source noise suppression is limited by β, with greater suppression achieved when using fabrication processes that enable larger β.

Figure 9:
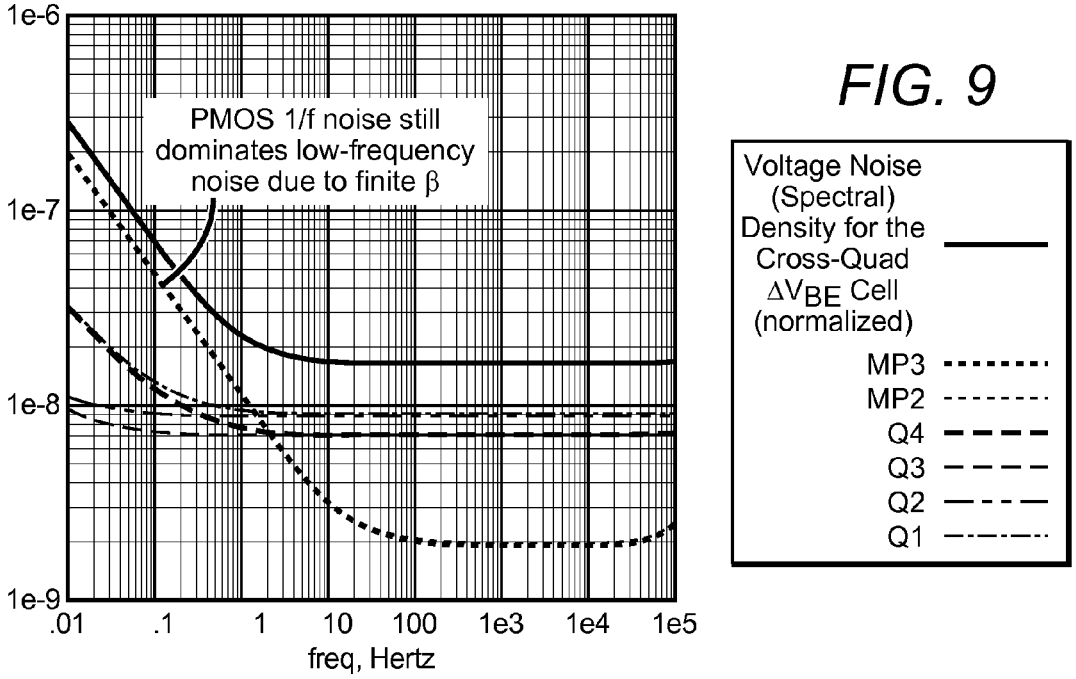
FIG. 9 is a plot of the constituent noise components of a cross-quad $\Delta V_{BE}$ cell such as that shown in FIG. 7.

A comparison of the noise of the cross-quad $\Delta V_{BE}$ cell with the quad and standard $\Delta V_{BE}$ cells is shown in FIG. 8. The 1/f noise of the cross-quad $\Delta V_{BE}$ cell is 7× lower than that of the quad and standard $\Delta V_{BE}$ cells (the β for the process was approximately 8), and the wideband noise is reduced by nearly 2× over the standard cell. FIG. 9 shows the constituent noise components of the cross-quad $\Delta V_{BE}$ cell. Due to finite β as described earlier, there is still a 1/f noise component due to the PMOS current minors; however, the overall contribution of the PMOS current mirror noise is reduced because of the cross-quad $\Delta V_{BE}$ configuration.

Figure 10:
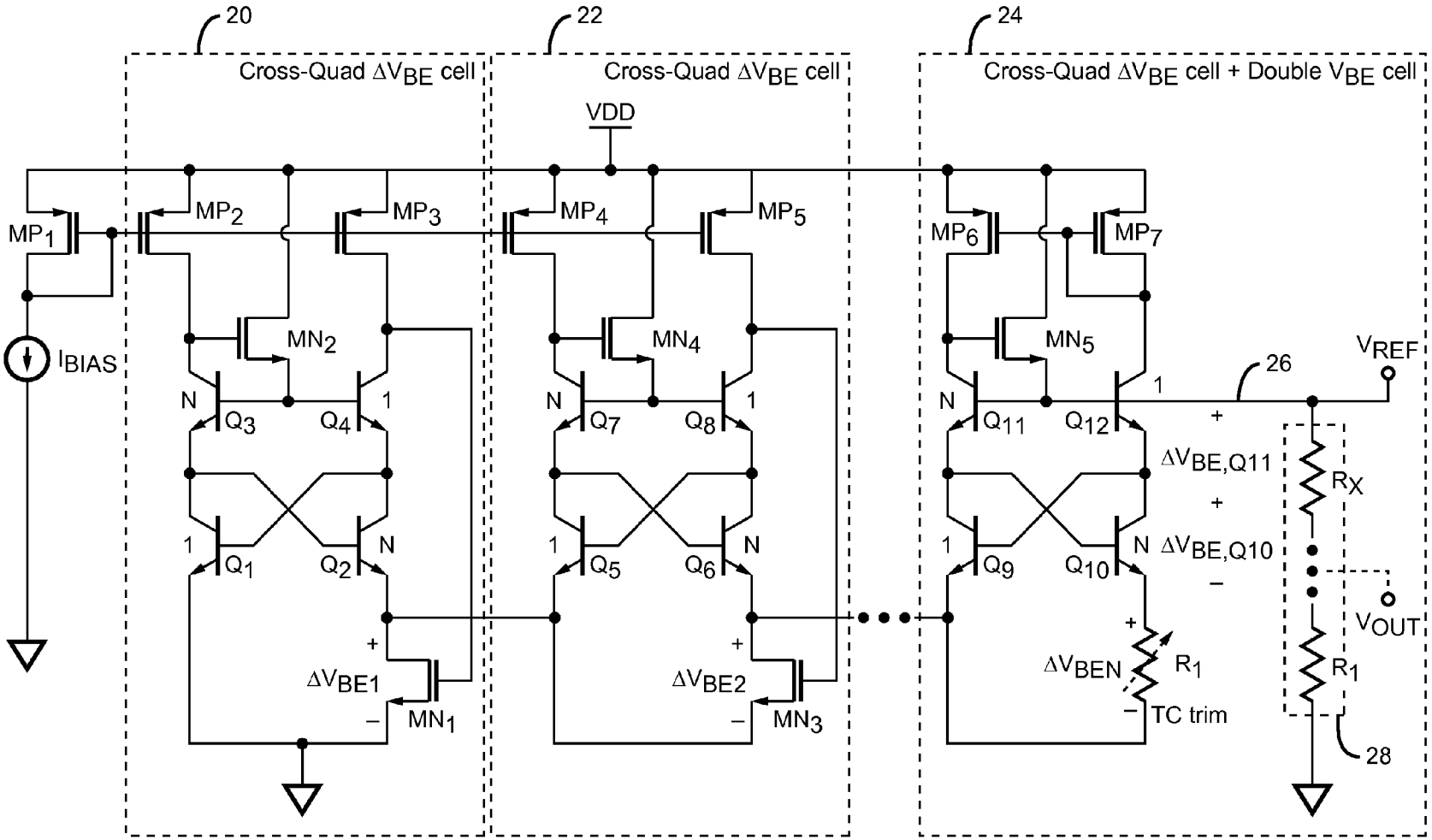
FIG. 10 is a schematic diagram of one possible embodiment of an ultra-low noise voltage reference circuit in accordance with the present invention.

Multiple cross-quad $\Delta V_{BE}$ cells can be stacked together and then coupled to a last stage to create a first-order zero TC voltage reference with ultra-low noise; one possible embodiment is shown in FIG. 10. Two cross-quad $\Delta V_{BE}$ cells 20 and 22 are shown in FIG. 10, though more or fewer cross-quad $\Delta V_{BE}$ cells could be used as needed. The stacked cross-quad $\Delta V_{BE}$ cells are connected such that their individual $\Delta V_{BE}$ voltages are summed. In the exemplary embodiment shown, this is accomplished by connecting the $\Delta V_{BE}$ voltage that appears across the resistance (MN1) in first cross-quad $\Delta V_{BE}$ cell 20 to the circuit common point of the second cross-quad $\Delta V_{BE}$ cell in the stack, connecting the $\Delta V_{BE}$ voltage across the resistance (MN3) in second cross-quad $\Delta V_{BE}$ cell 22 to the circuit common point of the third cross-quad $\Delta V_{BE}$ cell in the stack (if present), and so on.

The $\Delta V_{BE}$ voltage that appears across the resistance in the last cross-quad $\Delta V_{BE}$ cell in the stack is connected to a last stage 24, which, in the exemplary embodiment shown, is nearly identical to the other cross-quad $\Delta V_{BE}$ cells. The output 26 ($V_{REF}$) of the last stage is taken from the base of $Q_{11}$ and $Q_{12}$ such that the last stage contributes a cross-quad $\Delta V_{BE}$ voltage to the reference voltage output, along with two full $V_{BE}$ voltages which provide the CTAT component of the voltage reference. The $\Delta V_{BE}$ voltage provided by the last stage is given by:

$$\Delta V_{BE} = V_{BE,Q9} + V_{BE,Q12} - V_{BE,Q11} - V_{BE,Q10} = V_T \ln\left(N^2 \frac{I_{C9} \cdot I_{C12}}{I_{C11} \cdot I_{C10}} \frac{I_{S11} \cdot I_{S10}}{I_{S9} \cdot I_{S12}}\right),$$

where $V_T$ is the thermal voltage and $I_{C9}$, $I_{C10}$, $I_{C11}$ and $I_{C12}$ are the collector currents of Q9, Q10, Q11 and Q12, respectively. The voltage reference $V_{REF}$ is then given by:

$$V_{REF} = \Delta V_{BE1} + \Delta V_{BE2} + \ldots + \Delta V_{BEK} + (2 * V_{BE}).$$

Note that the currents in the last stage are sourced by a minor configuration (with MP7 diode-connected), instead of via two current sources as in the cross-quad $\Delta V_{BE}$ cells. Also, rather than using an NMOS FET as a resistance across which the cell's $\Delta V_{BE}$ voltage appears as in the preferred embodiment of the cross-quad cell, here the stage current is set by a resistor $R_1$, which may be made variable to provide a trim mechanism for the TC.

Most of the error in such circuits is due to the $V_{BE}$ term. In theory, $V_{BE}$ intersects VG0 (the bandgap voltage) at 0K. The slope away from 0K is determined by the sizing of the transistor providing the $V_{BE}$ voltage and the current through it—which will vary for each transistor and each die. Prior art designs typically add a fraction of a $V_{BE}$ voltage to a $\Delta V_{BE}$ voltage to obtain a zero TC. This means that the circuit adds K*VG0 at 0K, and 0 at some unknown temperature; that trim scheme rotates the $V_{BE}$ curve around the unknown temperature. The net result is that the "magic voltage" at which the bandgap voltage reference has zero TC changes from die to die. This makes trimming difficult, with both TC trim and gain trim mechanisms needed to provide acceptable performance.

The present trim scheme is to change the final stage current to affect a change in $V_{BE}$. This rotates the $V_{BE}$ curve around VG0 at 0K, and allows for the size and current errors to be nulled out in the same mathematical way as they enter. The end result is that the reference voltage output has zero TC at the same magic voltage for each die (assuming VG0 is not changing). This allows for a simple single point trim of the TC. Ideally, only a TC trim mechanism is needed, as the output will always be at the magic voltage. The output voltage of the reference is then divided down (via, for example, a voltage divider 26) to get a desired output voltage $V_{OUT}$.

The cross-quad $\Delta V_{BE}$ cell is described and shown as consisting of two NPNs as the $\Delta V_{BE}$ generators, two PMOS devices as the current minors, and an NMOS device as the variable resistor. However, it is conceivable that one could use, for example, NMOS FETs in weak inversion in lieu of the NPNs, or PNPs instead of PMOS FETs for the current minors, or an NPN instead of an NMOS FET MN2. Any variant of the $\Delta V_{BE}$ cell could be improved by the cross-quad technique.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A voltage reference circuit, comprising:

a plurality of $\Delta V_{BE}$ cells, each comprising four bipolar junction transistors (BJTs) connected in a cross-quad configuration and arranged to generate a $\Delta V_{BE}$ voltage, said plurality of $\Delta V_{BE}$ cells stacked such that their $\Delta V_{BE}$ voltages are summed; and a last stage which is coupled to said summed $\Delta V_{BE}$ voltages, said last stage arranged to generate multiple $V_{BE}$ voltages which are summed with said summed $\Delta V_{BE}$ voltages to provide a reference voltage.

2. The voltage reference circuit of claim 1, wherein said voltage reference circuit is arranged such that said reference voltage has a first-order temperature coefficient of zero.

3. The voltage reference circuit of claim 1, wherein each of said $\Delta V_{BE}$ cells comprises:

a first bipolar junction transistor (BJT) Q1 having an area $A_1$ with its base terminal connected to a first node, emitter terminal connected to a circuit common point, and collector terminal connected to a second node;

a second bipolar junction transistor (BJT) Q2 having an area $A_2$ with its base terminal connected to said second node, emitter terminal connected to a third node, and collector terminal connected to said first node;

a third bipolar junction transistor (BJT) Q3 having an area $A_3$ with its base terminal connected to a fourth node, emitter terminal connected to said second node, and collector terminal connected to a fifth node;

a fourth bipolar junction transistor (BJT) Q4 having an area $A_4$ with its base terminal connected to said fourth node, emitter terminal connected to said first node, and collector terminal connected to a sixth node;

said fifth and sixth nodes receiving first and second currents I1 and I2, respectively; and a resistance connected between said third node and said circuit common point.

4. The voltage reference circuit of claim 3, wherein said first and second currents are provided by current sources.

5. The voltage reference circuit of claim 4, wherein said first and second currents are provided by:

a fixed current source;

a diode-connected transistor; and first and second minor transistors, said diode-connected transistor and said first and second minor transistors connected such that the current provided by said fixed current source is mirrored to said third and fourth nodes, said mirrored currents being I1 and I2.

6. The voltage reference circuit of claim 5, wherein said first and second mirror transistors are PMOS FETs or PNP transistors.

7. The voltage reference circuit of claim 3, arranged such that I1=I2.

8. The voltage reference circuit of claim 3, wherein A1=A4 and A2=A3=N*A1, where N≠1.

9. The voltage reference circuit of claim 3, wherein the $\Delta V_{BE}$ voltage across the resistance in the first $\Delta V_{BE}$ cell in said stack is connected to the circuit common point of the second $\Delta V_{BE}$ cell in said stack, the $\Delta V_{BE}$ voltage across the resistance in second $\Delta V_{BE}$ cell in said stack is connected to the circuit common point of the third $\Delta V_{BE}$ cell in said stack, and so on.

10. The voltage reference circuit of claim 3, wherein said resistance is a FET, said FET connected such that it is driven to conduct a current sufficient to maintain said $\Delta V_{BE}$ cell in an equilibrium state.

11. The voltage reference circuit of claim 3, further comprising a transistor connected between said fifth node and said fourth node and arranged to drive the bases of Q3 and Q4.

12. The voltage reference circuit of claim 11, wherein said transistor connected between said fifth node and said fourth node is an NMOS FET or an NPN.

13. The voltage reference circuit of claim 3, wherein the $\Delta V_{BE}$ voltage across the resistance is given by:

$$\Delta V_{BE} = V_{BE,Q1} + V_{BE,Q4} - V_{BE,Q3} - V_{BE,Q2} = V_T \ln\left(\frac{I_{S2} \cdot I_{S3}}{I_{S1} \cdot I_{S4}} \cdot \frac{I_{C1} \cdot I_{C4}}{I_{C2} \cdot I_{C3}}\right),$$

where $I_{S1}$, $I_{S2}$, $I_{C2}$, $I_{S3}$, $I_{C3}$, $I_{S4}$, and $I_{C4}$, are the saturation and collector currents of Q1, Q2, Q3 and Q4, respectively, and $I_{C3}$=I1 and $I_{C4}$=I2.

14. The voltage reference circuit of claim 1, wherein said last stage comprises:

a $\Delta V_{BE}$ cell comprising four bipolar junction transistors (BJTs) connected in a cross-quad configuration and arranged to generate a $\Delta V_{BE}$ voltage and at least one $V_{BE}$ voltage which are summed with said summed $\Delta V_{BE}$ voltages.

15. The voltage reference circuit of claim 14, wherein said last stage comprises:

a first bipolar junction transistor (BJT) Q1 having an area $A_1$ with its base terminal connected to a first node, emitter terminal connected to a circuit common point, and collector terminal connected to a second node;

a second bipolar junction transistor (BJT) Q2 having an area $A_2$ with its base terminal connected to said second node, emitter terminal connected to a third node, and collector terminal connected to said first node;

a third bipolar junction transistor (BJT) Q3 having an area $A_3$ with its base terminal connected to a fourth node, emitter terminal connected to said second node, and collector terminal connected to a fifth node;

a fourth bipolar junction transistor (BJT) Q4 having an area $A_4$ with its base terminal connected to said fourth node, emitter terminal connected to said first node, and collector terminal connected to a sixth node;

said fifth and sixth nodes receiving first and second currents I1 and I2, respectively; and a resistance connected between said third node and said circuit common point;

said last stage's circuit common point connected to receive said summed $\Delta V_{BE}$ voltages;

said reference voltage taken at a node such that said summed $\Delta V_{BE}$ voltages are summed with at least one $V_{BE}$ voltage.

16. The voltage reference circuit of claim 15, wherein said reference voltage is taken at said first node such that said summed $\Delta V_{BE}$ voltages are summed with the $V_{BE}$ voltage of said first BJT.

17. The voltage reference circuit of claim 15, wherein said reference voltage is taken at said second node such that said summed $\Delta V_{BE}$ voltages are summed with the $V_{BE}$ voltage of said second BJT.

18. The voltage reference circuit of claim 15, wherein said last stage has an associated supply voltage, further comprising a supply-voltage referred current mirror arranged to mirror said current I2 to said fifth node to provide said current I1.

19. The voltage reference circuit of claim 15, wherein said resistance is a variable resistance, such that the temperature coefficient of said reference voltage can be trimmed by varying said resistance.

20. The voltage reference circuit of claim 15, wherein said reference voltage is taken at said fourth node such that said summed $\Delta V_{BE}$ voltages are summed with the $V_{BE}$ voltages of said second and third BJTs.

21. The voltage reference circuit of claim 15, wherein the $\Delta V_{BE}$ voltage across the resistance is given by:

$$\Delta V_{BE} = V_{BE,Q1} + V_{BE,Q4} - V_{BE,Q3} - V_{BE,Q2} = V_T \ln\left(\frac{I_{S2} \cdot I_{S3}}{I_{S1} \cdot I_{S4}} \cdot \frac{I_{C1} \cdot I_{C4}}{I_{C2} \cdot I_{C3}}\right),$$

where $I_{S1}$, $I_{C1}$, $I_{S2}$, $I_{C2}$, $I_{S3}$, $I_{C3}$, $I_{S4}$, and $I_{C4}$ are the saturation and collector currents of Q1, Q2, Q3 and Q4, respectively, and $I_{C3}$=I1 and $I_{C4}$=I2.

22. A voltage reference circuit comprising:

a first bipolar junction transistor (BJT) Q1 having a base terminal connected to a first node, an emitter terminal connected to a circuit common point, and collector terminal connected to a second node;

a second bipolar junction transistor (BJT) Q2 having a base terminal connected to said second node, an emitter terminal connected to a third node, and collector terminal connected to said first node;

a third bipolar junction transistor (BJT) Q3 having a base terminal connected to a fourth node, an emitter terminal connected to said second node, and collector terminal connected to a fifth node;

a fourth bipolar junction transistor (BJT) Q4 having a base terminal connected to said fourth node, an emitter terminal connected to said first node, and collector terminal connected to a sixth node; and a field effect transistor (FET) connected between said third node and said circuit common point, wherein a voltage across said FET is a $\Delta V_{BE}$ voltage.

23. The voltage reference circuit of claim 22, further comprising a transistor connected between said fifth node and said fourth node and arranged to drive the bases of Q3 and Q4.

24. The voltage reference circuit of claim 22, further comprising a plurality of $\Delta V_{BE}$ cells electrically connected in a stack, wherein the $\Delta V_{BE}$ voltage across the FET comprises a $\Delta V_{BE}$ voltage in a first $\Delta V_{BE}$ cell in said stack and is connected to a circuit common point of a second $\Delta V_{BE}$ cell in said stack, wherein the $\Delta V_{BE}$ voltage across a FET in the second $\Delta V_{BE}$ cell in said stack is connected to a circuit common point of a third $\Delta V_{BE}$ cell in said stack.

25. The voltage reference circuit of claim 22, wherein Q1, Q2, Q3, Q4, and the FET operate as a $\Delta V_{BE}$ cell, wherein said FET connected such that it is driven to conduct a current sufficient to maintain said $\Delta V_{BE}$ cell in an equilibrium state.

26. The voltage reference circuit of claim 22, wherein the $\Delta V_{BE}$ voltage across the FET is given by:

$$\Delta V_{BE} = V_{BE,Q1} + V_{BE,Q4} - V_{BE,Q3} - V_{BE,Q2} = V_T \ln\left(\frac{I_{S2} \cdot I_{S3}}{I_{S1} \cdot I_{S4}} \cdot \frac{I_{C1} \cdot I_{C4}}{I_{C2} \cdot I_{C3}}\right),$$

where $I_{S1}$, $I_{C1}$, $I_{S2}$, $I_{C2}$, $I_{S3}$, $I_{C3}$, $I_{S4}$, and $I_{C4}$ are the saturation and collector currents of Q1, Q2, Q3 and Q4, respectively.

27. A voltage reference circuit comprising:

a first NMOS FET Q1 having a gate terminal connected to a first node, a source terminal connected to a circuit common point, and a drain terminal connected to a second node;

a second NMOS FET Q2 having a gate terminal connected to said second node, a source terminal connected to a third node, and a drain terminal connected to said first node;

a third NMOS FET Q3 having a gate terminal connected to a fourth node, a source terminal connected to said second node, and a drain terminal connected to a fifth node;

a fourth NMOS FET Q4 having a gate terminal connected to said fourth node, a source terminal connected to said first node, and a drain terminal connected to a sixth node; and a FET connected between said third node and said circuit common point, wherein a voltage across said FET is proportional to absolute temperature.

28. The voltage reference circuit of claim 27, further comprising a transistor connected between said fifth node and said fourth node and arranged to drive the gates of Q3 and Q4.

29. The voltage reference circuit of claim 27, wherein the voltage across the FET is a $\Delta V_{BE}$ voltage.

* * * * *